United States Patent [19]

Markiewicz et al.

[11] Patent Number: 4,926,667

[45] Date of Patent: May 22, 1990

[54] METHOD OF SIZING AND STRAIGHTENING EXTRUDED TUBES

[75] Inventors: James E. Markiewicz, Roselle; Darrell G. Shrontz, Elgin, both of Ill.

[73] Assignee: Precision Extruded Products, Inc., Elgin, Ill.

[21] Appl. No.: 339,317

[22] Filed: Apr. 17, 1989

[51] Int. Cl.[5] ..... B21C 23/00; B21C 45/00; B21D 3/00

[52] U.S. Cl. ..... 72/256; 72/370

[58] Field of Search ..... 72/256, 370, 476, 479

[56] References Cited

U.S. PATENT DOCUMENTS

| | | | |
|---|---|---|---|
| 2,234,863 | 3/1941 | Heetkamp | 72/370 |
| 2,467,668 | 4/1949 | Hallberg | 72/479 |
| 2,728,373 | 12/1955 | Zimpel | 72/370 |
| 3,078,905 | 2/1963 | Somers et al. | 72/370 |
| 3,243,986 | 4/1966 | Douthett et al. | 72/370 |
| 4,089,199 | 5/1978 | Siemonsen | 72/370 |
| 4,316,373 | 2/1982 | Zilges et al. | 72/264 |

FOREIGN PATENT DOCUMENTS

| | | | |
|---|---|---|---|
| 648920 | 8/1937 | Fed. Rep. of Germany | 72/370 |
| 250639 | 8/1969 | U.S.S.R. | 72/370 |
| 497318 | 12/1938 | United Kingdom | 72/370 |

*Primary Examiner*—Robert L. Spruill

*Attorney, Agent, or Firm*—Hill, Van Santen, Steadman & Simpson

[57] ABSTRACT

A method for extruding a metal tube to a precise internal diameter and a precise linear camber is provided by sizing and straightening the tube with a mandrel after the tube has been extruded to an approximate size. The mandrel is to have a taper so that a smaller end is inserted into the tube and then the mandrel is advanced to cause the tube to be inelastically deformed. The insertion is to proceed at a relatively slow speed in the range of 2.2 feet per minute to 1 inch per second until a desired constant diameter portion of the mandrel has been fully inserted into the tube. The insertion speed thereafter can be increased up to a speed of 48 feet per minute through the remaining length of the mandrel. Withdrawal of the mandrel preferably also occurs at a first slow speed until the constant diameter portion is withdrawn from the tube and then further withdrawal can proceed at a higher speed.

14 Claims, 2 Drawing Sheets

TIME (Sec)
SPEED (Ft/Sec)
48
2.2
Reservoir
P
P

METHOD OF SIZING AND STRAIGHTENING EXTRUDED TUBES

BACKGROUND OF THE INVENTION

The present invention relates to methods of extruding and more particularly to a method for extruding an aluminum tube having a knurled outer surface.

Extruded tubes are well known in the art and the process for manufacturing such tubes, when made from aluminum, generally comprises heating aluminum logs or billets and, under the influence of pressure, generally provided by hydraulics, and high temperature, the aluminum material is extruded through a die in which the center of the tube is relatively smooth and the external surface of the tube may have a knurled contour.

It has been found, however, that tubes formed by such a method cannot be held to a high degree of accuracy in that the resulting outer diameter (OD) and inner diameter (ID) of the tubes and more particularly their straightness or camber may vary greater than the permitted tolerances. Thus, there is a high degree of rejection of the tubes formed by this process resulting in substantial reworking of the material. The time and cost involved in the reworking significantly increases the cost to produce acceptable parts.

SUMMARY OF THE INVENTION

The present invention provides a method for producing extruded aluminum tubes having an outer knurled surface in which the internal diameter and the camber of the tube is held to a high degree of accuracy in the finished product. In the inventive method the tube is first formed in accordance with the known method described above and after extruded, the tube is stretched to straighten the tube. Such stretching however, does not result in a sufficiently accurate straightness of the tube. After stretching, the tubes are rough cut to a desired length and then the tube is resized and further straightened. The resizing and further straightening of the tube is a critical step in the process and requires the use of a special mandrel which is pushed through the tube to cause the resizing and straightening. In a preferred arrangement, the mandrel is sized about 3–6 thousandths of an inch larger than the ID of the extruded tube. The mandrel is to be sized exactly at the mean size of the customer specifications for the internal diameter and the extruded tube is made so that it is 3–6 thousandths of an inch smaller than the mandrel. The 3–6 thousandths is sufficient to exceed the elastic limit of the metal to assure that a permanent deformation occurs. The finished product thus is sized exactly to the desired internal diameter and retains the straightness of the mandrel.

The rough cut tube length is placed in a holder to be held in a fixed position and the mandrel is inserted into an end of the tube and is slowly pressed through the tube at a rate in the range of 2.2 inches per minute to one inch per second. The mandrel itself has an initial tapered section which begins with a diameter less than the internal diameter of the tube and, through a series of spaced rings, increases in diameter up to the desired final size. A length of the mandrel at least as long as the tube includes spaced rings of the final desired diameter size.

The mandrel is slowly advanced into the tube until the initial increasing sized rings have passed through the tube at which time the mandrel is then advanced rapidly, up to 24 feet per minute, until the useable portion of the mandrel has been inserted through the tube. After the mandrel has been fully inserted, the mandrel is retracted and the retraction begins slowly until smaller diameter rings are positioned in the tube at which time the removal can be accelerated. After the mandrel is fully withdrawn from the tube, the tube is removed for further cutting to exact length and cleaning and a new tube to be sized and straightened is placed in the holder.

DETAILED DESCRIPTION OF THE PREFERRED EMBODIMENTS

Figures 1, 2:
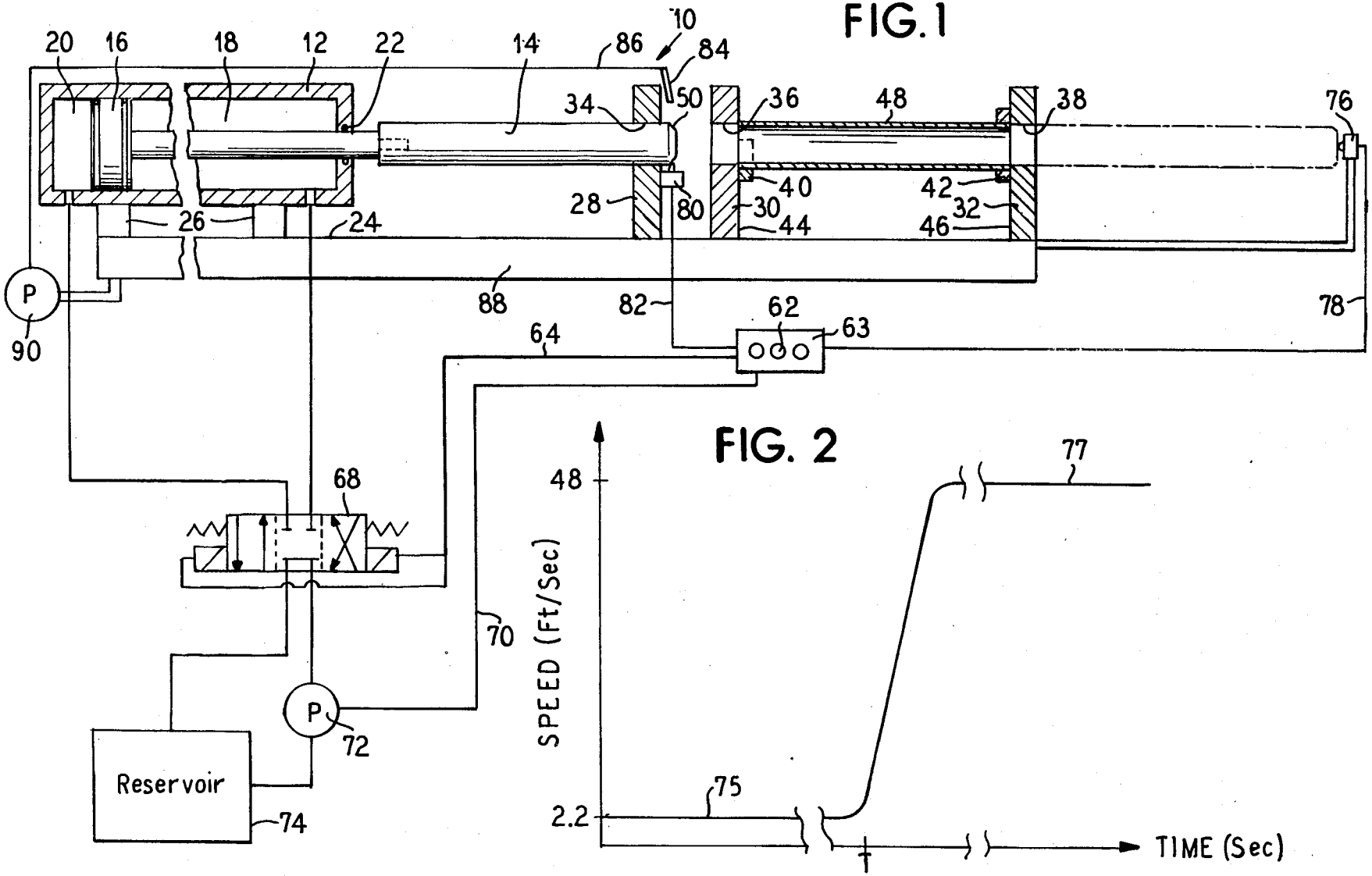
FIG. 1 is a schematic illustration of a device for performing the steps of the present invention.
FIG. 2 is a graphic representation of speed versus time for the movement of the expanding mandrel used in the device shown in FIG. 1.

In FIG. 1 there is illustrated a sizing and straightening machine generally at 10 which can be utilized for performing the steps of the present invention. The machine 10 includes a hydraulic cylinder 12 which carries therein a mandrel 14 which protrudes from one end of the cylinder 12. A piston 16 is carried on the mandrel within the hydraulic cylinder such that a forward chamber 18 and a rear chamber 20 are formed within the hydraulic cylinder. A seal 22 is provided at the opening where the mandrel 14 protrudes from the hydraulic cylinder 12 in a manner well known to those skilled in the art.

The hydraulic cylinder 12 is carried on a table 24 by a plurality of support blocks 26. Additional support blocks 28, 30 and 32 are provided on the table, each having an opening 34, 36, 38 therethrough for receiving the mandrel 14. Support blocks 30, 32 have tube supporting means 40, 42 secured to surfaces 44, 46 of the support blocks 30, 32 which face each other. Such support means are provided to supportingly engage an extruded tube 48 which is to be sized and straightened by the mandrel 14.

Figure 3:
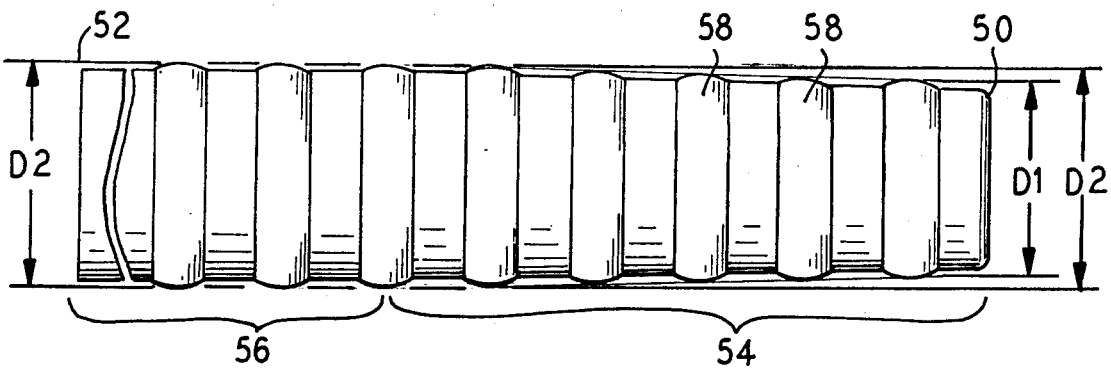
FIG. 3 is an enlarged partial view of the mandrel used in the device of FIG. 1.

The mandrel 14 is shown in greater detail in FIG. 3 where it is seen that a forward end 50 as a diameter D1 smaller than a rearward end 52. Further, the mandrel 14 has a first portion 54 which is tapered from the smaller forward end 50 diameter to the rearward end 52 diameter. A second, rearward portion 56 of the mandrel has a relatively constant diameter. The rearward portion 56 of the mandrel must have a length at least as long as a length 57 (FIG. 4) of the tube. Also, the mandrel has formed thereon a series of spaced, raised rings 58 which rings have a diameter slightly larger than the surrounding or adjacent mandrel diameter, each to the relatively same degree. The extruded tube 48 is formed such that it has an internal diameter 60 (FIG. 4) at least as large, or perhaps somewhat greater than the forward end 50 diameter of the mandrel, but it is 3–6 thousandths of an inch smaller than the diameter of the rings 58 at the rearward end 52 of the mandrel.

Figure 4:
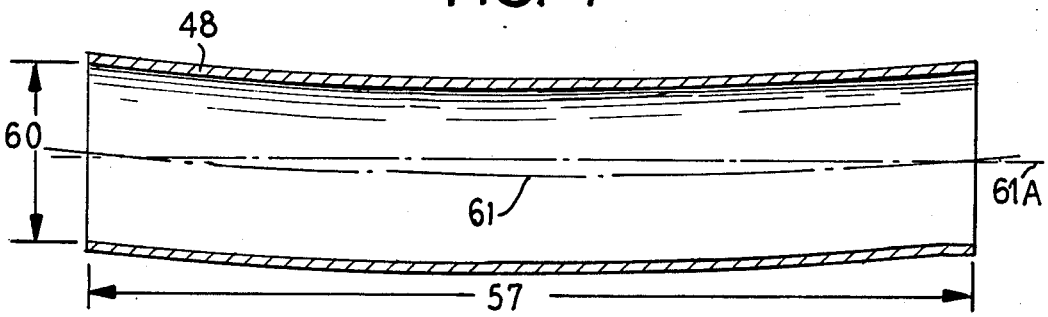
FIG. 4 is a sectional view of a raw extruded tube prior to the finishing method of the present invention.

FIG. 4 also shows in an exaggerated manner the curved nature of the tube 48 in that a centerline 61 of the tube 48 is not linear in comparison with a desired axial line 61A of the tube.

To begin the sizing and straightening operation, a start button 62 is depressed on a control 63 sending a control signal on lines 64 to valves 68 in the hydraulic system and a control signal on line 70 to a pump 72 which causes hydraulic fluid to be moved by the pump 72 from a reservoir 74 into the rear chamber 20 of the hydraulic cylinder 12. The hydraulic fluid presses on piston 16 causing the mandrel 14 to move to the right as seen in FIG. 1 such that the mandrel end 50 enters the tube 48.

It is important during this sizing operation that the mandrel be slowly pressed into the tube 48 so that the tube will be slowly stretched and straightened.

Figure 5:
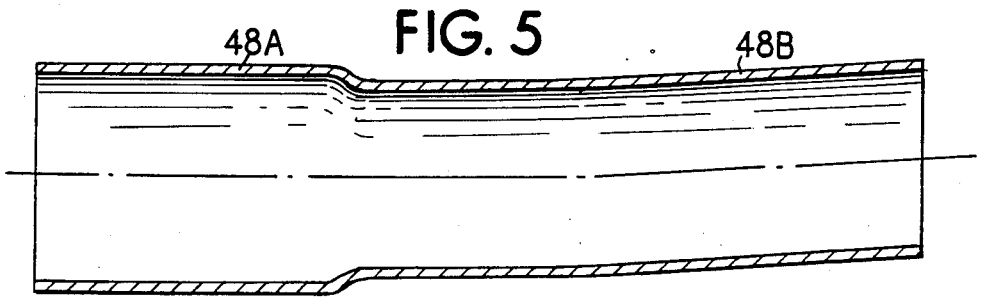
FIG. 5 is a schematic illustration of the tube during the finishing operation.

Applicants have determined when the tube is formed of a 6000 series aluminum alloy, and in particular 6063 alloy aluminum, and wherein the tubes have an internal diameter of in the range of 1.062 to 1.3 inches and an external diameter in the range of 1.16 to 1.75 inches, an initial speed of the mandrel 14 should be in the range of 2.2 inches per minute to 1 inch per second. (A partially sized and straightened tube 48 is illustrated in FIG. 5 showing a stretched portion 48A and a prestretched portion 48B). Such low speed, as shown graphically at 75 in FIG. 2 continues for a sufficient length of time T until the first tapered portion 54 of the mandrel has passed all of the way through the tube 48 and the second portion 56 of the mandrel completely fills the tube i.e., has entered the portion of the tube through which the first tapered portion has already passed. At that time the insertion speed can be increased, as shown at 77 in FIG. 2 up to a speed of 48 feet per minute until the remainder or second portion 56 of the mandrel has been extended into the tube 48.

Figure 6:
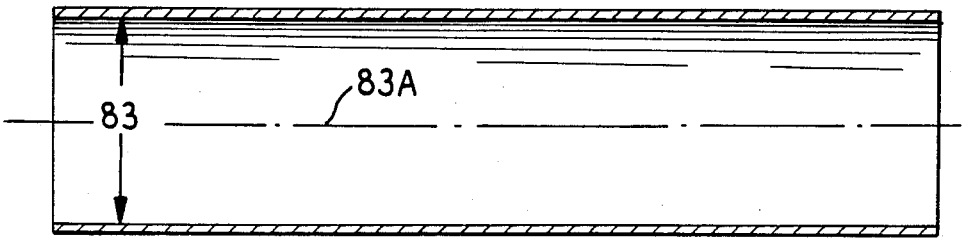
FIG. 6 is a side sectional view of a finished tube made in accordance with the principles of the present invention.

At that point, the end 50 of the mandrel will depress a switch 76 sending a signal on line 78 back to the control 63 which will again send a signal out on line 64 to reverse the position of the valve to now cause hydraulic fluid to be pumped into the forward chamber 18 of the hydraulic cylinder against the piston 16 causing the mandrel 14 to withdraw. Applicants have found it desireable to begin the withdrawal of the mandrel at the relatively slow rate described above at least until the second, constant diameter portion 56 of the mandrel has been completely withdrawn from the tube 48 and at that time the speed of withdrawal can be increased up to the higher speed indicated above for the remainder of the withdrawal process. A second switch 80 will detect the presence of the reduced diameter portion of the mandrel 14 and will send a signal on line 82 to the control 63 to terminate operation of the pump 72. Upon withdrawal, the tube 48 will have an internal diameter 83 (FIG. 6) equal to that of the rings 58 at the rearward end 56 of the mandrel since the elastic limit of the metal is exceeded by the insertion of the mandrel. Also, a centerline 83A of the tube will be linear to a highly accurate degree.

Applicants have also found it desireable, during the sizing process, to provide a supply of lubricating oil onto the mandrel 14 as it enters the tube 48. This is schematically shown as an oil nozzle 84 which directs the oil flow from line 86 onto the end 50 of the mandrel before it engages into the tube 48. Excess oil will flow into a reservoir 88 from where it is pumped by pump 90 back to line 86 for reuse.

The initial insertion of the mandrel 14 into the tube 48 can be controlled either by a switch similar to switches 76 and 80 detecting movement of the mandrel 14 to a specific position indicating that the constant diameter rearward portion 56 has been fully inserted into the tube, or, a timer can be incorporated into the control 63 since the mandrel 14 can be moved at a predetermined rate of speed and therefore a given time will result in a given movement distance of the mandrel 14.

Applicants have also found it useful to use a pneumatic control as control 63 with switches 80 and 76 being pneumatic switches and the signal sent on lines 78, 82, 64 and 70 being pneumatic signals in the form of increased or decreased pressures because of the environment in which the apparatus is operated, that being one where many of the working parts of the apparatus become coated with oil due to the oil lubricating and recirculating system.

It will be appreciated that many of the components such as the mandrel 14 and the support blocks 28, 30, 32 can be removable and replaceable with other blocks to permit varying the size of the tube 48 which is to be sized and straightened during the operation. Thus, tubes of differing diameter and length can be sized by using the proper mandrel and support block sizes.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A method of sizing and straightening an extruded tube comprising:

extruding a tube of metal having a predetermined internal diameter;

inserting a tapered mandrel having a first portion with an increasing external diameter and a second portion with a relatively large, constant diameter and a length as long as the tube into said tube at a first low insertion speed until the second portion of the mandrel having the large, constant external diameter has entered into that part of the tube pre-expanded by the first portion and then increasing the insertion speed until the mandrel has been fully inserted and the tube fully expanded; and withdrawing the mandrel from the tube at a first low withdrawal speed until the large, constant diameter second portion of the mandrel has been completely withdrawn from the tube and then increasing the withdrawal speed until the entire mandrel is completely withdrawn from the tube.

2. A method according to claim 1, including the steps of applying a lubricant to said mandrel prior to inserting it into said tube.

3. A method according to claim 1, wherein said first low insertion speed is in the range of 2.2 inches per minute to 1 inch per second.

4. A method according to claim 1, wherein said insertion speed is increased to a speed up to 48 feet per minute.

5. A method according to claim 1, wherein said first withdrawal speed is in the range of 2.2 inches per minute to 1 inch per second.

6. A method according to claim 1, wherein said withdrawal speed is increased to a speed up to 48 feet per minute.

7. A method of sizing and straightening an extruded tube comprising:

extruding a tube of metal having a predetermined internal diameter;

inserting a tapered mandrel having a portion with a diameter less than the internal diameter of the tube and a portion with a diameter larger than that of the tube into the tube until the larger diameter portion has fully entered the tube; and withdrawing the mandrel from the tube;

wherein the insertion and withdrawal of the mandrel each are carried out at two different speeds depending on the location of the larger diameter portion of the mandrel relative to the tube, wherein the insertion and withdrawal are first carried out at a low speed until the larger diameter portion of the mandrel enters or exits, respectively, and further insertion and withdrawal is then carried out a higher speed.

8. A method according to claim 7, wherein said low speed is in the range of 2.2 inches per minute to 1 inch per second.

9. A method according to claim 8, wherein said higher speed is a speed up to 48 feet per minute.

10. A method according to claim 7, including the step of applying a lubricant to said mandrel prior to inserting it into said tube.

11. A method of sizing the internal diameter and straightening the centerline of an extended aluminum tube within precise tolerance comprising:

extruding an aluminum tube to have an approximate predetermined internal diameter;

inserting an insertion length of a tapered mandrel having a forward portion with a diameter less than the internal diameter of the tube and intermediate portion of increasing diameter and a rearward portion with a constant diameter equal to the final desired diameter for the tube into the tube at a first low insertion speed until the forward portion has been inserted through the tube and the rearward portion has fully entered the tube and then increasing the insertion speed until the entire insertion length of the mandrel has been inserted into the tube;

withdrawing the mandrel from the tube at a first slow withdrawal speed until the rearward portion of the mandrel has been withdrawn from the tube and then increasing the withdrawal speed of the mandrel from the tube until the entire mandrel is completely withdrawn from the tube.

12. A method according to claim 11, including the step of applying a lubricant to said mandrel prior to inserting it into said tube.

13. A method according to claim 11, wherein said low insertion speed is in the range of 2.2 inches per minute to 1 inch per second.

14. A method according to claim 11, wherein said insertion speed is increased to a speed up to 48 feet per minute.

* * * * *